US008832879B2

(12) United States Patent
Rubio

(10) Patent No.: US 8,832,879 B2
(45) Date of Patent: Sep. 16, 2014

(54) CUSHIONED SUPPORT DEVICES

(76) Inventor: Ilse Rubio, Los Angeles, CA (US)

( * ) Notice: Subject to any disclaimer, the term of this patent is extended or adjusted under 35 U.S.C. 154(b) by 621 days.

(21) Appl. No.: 12/924,323

(22) Filed: Sep. 24, 2010

(65) Prior Publication Data

US 2011/0010863 A1 Jan. 20, 2011

Related U.S. Application Data

(63) Continuation-in-part of application No. 29/316,813, filed on Nov. 4, 2009, now Pat. No. Des. 628,298, which is a continuation-in-part of application No. 12/218,747, filed on Jul. 17, 2008, now abandoned.

(51) Int. Cl.
*A47C 20/02* (2006.01)
*A47C 20/00* (2006.01)

(52) U.S. Cl.
CPC ..... *A47C 20/026* (2013.01); *A47C 20/02* (2013.01)
USPC ..... 5/652; 5/632; 5/735

(58) Field of Classification Search
CPC ..... A47G 9/10; A47C 20/026; A47C 20/02; A47C 20/00; A61G 7/07; A61G 13/122
USPC ..... 5/652, 631, 632, 630, 735, 731, 930
See application file for complete search history.

(56) References Cited

U.S. PATENT DOCUMENTS 2,085,296 A * 6/1937 Carey ..... 5/630
D220,823 S * 5/1971 Howe et al. ..... D6/599
3,967,335 A * 7/1976 Rhoads ..... 5/632
D271,647 S * 12/1983 McLeod ..... D6/596
D271,657 S * 12/1983 Richmond, II ..... D7/661
4,596,384 A * 6/1986 Blosser ..... 5/613
D309,542 S * 7/1990 Glenn ..... D6/596
5,095,569 A * 3/1992 Glenn ..... 5/490
7,082,633 B1 * 8/2006 Maarbjerg ..... 5/636
7,194,778 B2 * 3/2007 Riach ..... 5/735
7,426,762 B2 * 9/2008 Dazzi ..... 5/632
D628,298 S * 11/2010 Rubio ..... D24/183
8,205,286 B1 * 6/2012 Diaz ..... 5/735
8,458,835 B2 * 6/2013 Muratalla ..... 5/655.9
2004/0029484 A1 * 2/2004 Smith ..... 450/1
2006/0031993 A1 * 2/2006 Riach ..... 5/632
2006/0174414 A1 * 8/2006 Maarbjerg ..... 5/636
2007/0089240 A1 * 4/2007 Dazzi ..... 5/630
2010/0011508 A1 * 1/2010 Rubio ..... 5/632
2011/0010863 A1 * 1/2011 Rubio ..... 5/652
2011/0083278 A1 * 4/2011 Muratalla ..... 5/655.9

* cited by examiner

*Primary Examiner* — Robert G Santos
(74) *Attorney, Agent, or Firm* — Ilse Rubio

(57) ABSTRACT

The female cushion/pillow support devices described herein may provide comfort and/or support to a woman's breasts while lying in a prone position, e.g., on their stomach. For example, the support devices herein may enhance comfort for women after an operation and/or experiencing other medical issues, women with breast augmentation, and the like, to facilitate them lying in the prone position. In addition, the support devices may protect the breasts when flattened by the woman's weight. The support device may have a thickness sufficient to raise the user's body away from the support surface to reduce or substantially eliminate pressure on the breasts received within the openings.

18 Claims, 8 Drawing Sheets

CUSHIONED SUPPORT DEVICES

RELATED APPLICATION DATA

This application is a continuation-in-part of application Ser. No. 29/316,813, filed Nov. 4, 2009, now U.S. Pat. No. Des. 628,298, which is a continuation-in-part of application Ser. No. 12/218,747, filed Jul. 17, 2008, now abandoned. The entire disclosure of these applications is expressly incorporated by reference herein.

FIELD OF THE INVENTION

The present invention generally relates to cushioning devices and, more particularly, to pillows or support devices, e.g., for providing support to a user, and to methods for making and using such support devices.

BACKGROUND

Cushions or pillows have been suggested for use by a woman, i.e., that include holes or recesses therein, e.g., to accommodate and/or receive the woman's breasts. U.S. Pat. Nos. 3,967,335 to Rhoads, 6,185,768 to Schlechter, D220, 823 to Howe et al., and U.S. Publication No. 2007/0089240 to Dazzi disclose various pillow or cushions.

Accordingly, cushioning and/or support devices that provide support of a woman without applying pressure to the woman's breasts would be useful.

SUMMARY

The present invention is directed generally to cushioning devices and, more particularly, to pillows or support devices, e.g., for providing support to a user, and to methods for making and using such support devices.

The female cushion/pillow support devices described herein may provide comfort and/or support to a woman's breasts while lying in a prone position, e.g., on their stomach. For example, the support devices herein may enhance comfort for women after an operation and/or experiencing other medical issues, women with breast augmentation, and the like, to facilitate them lying in the prone position. In addition, the support devices may protect the breasts when flattened by the woman's weight, and/or may relax the neck, shoulders, and/or back. The support devices herein may portable, light weight, relatively small sized, and easy to carry, and/or may be fit to different women's sizes and proportions.

In accordance with one embodiment, a cushioned support device is provided that includes a cushioned panel or body including a pair of openings therein and spaced apart from one another each for receiving a breast therein. Optionally, the panel or body may be at least partially covered with a cover. The panel or body may be formed from one or more sections of conformable material, e.g., foam, an inflatable body, and the like.

In accordance with yet another embodiment, a method is provided for supporting a woman's breasts above a support surface, e.g., a bed, floor, and the like, that includes positioning a cushioned support device on a support surface that includes a pair of spaced apart openings in a conformable body; and lying against the support device such that the woman's breasts extend into the openings in the body.

The support device may have a thickness sufficient to raise the user's body away from the support surface to reduce or substantially eliminate pressure on the breasts received within the openings.

Other aspects and features of the present invention will become apparent from consideration of the following description taken in conjunction with the accompanying drawings.

BRIEF DESCRIPTION OF THE DRAWINGS

The drawings illustrate exemplary embodiments of the invention, in which.

DETAILED DESCRIPTION OF THE EXEMPLARY EMBODIMENTS

Figure 1:
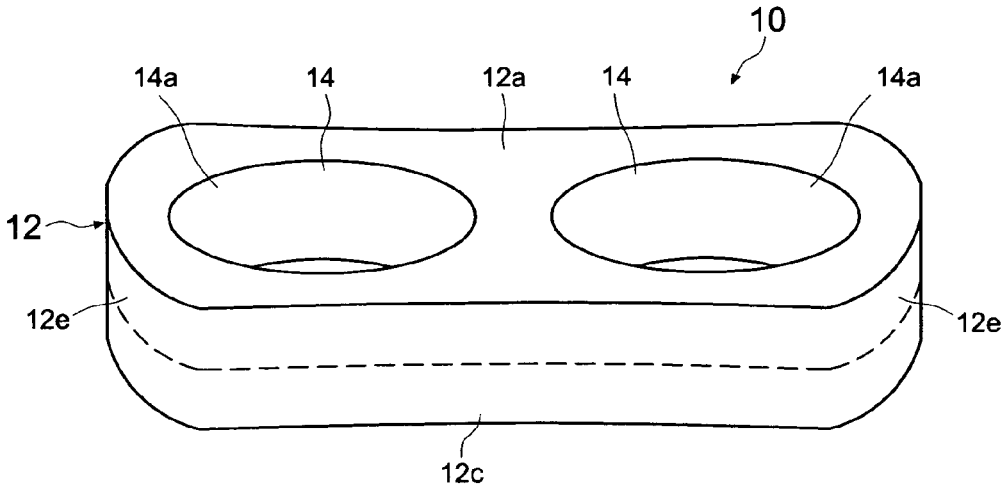
FIG. 1 is a front perspective view of an exemplary embodiment of a cushioned support device.
Figure 2:
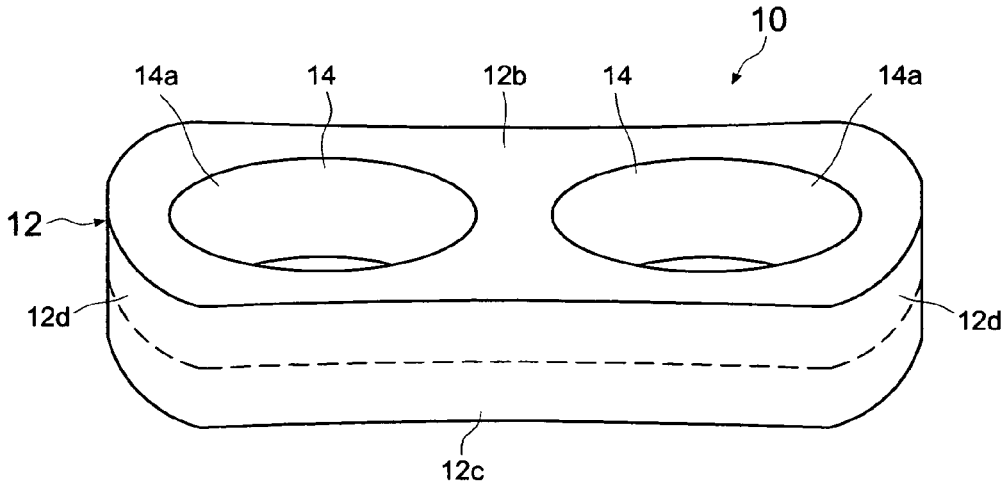
FIG. 2 is a rear perspective view of the device of FIG. 1.

Turning to the drawings, FIGS. 1-6 show a first exemplary embodiment of a support device or cushion 10 that generally includes an elongated cushioned body 12 including openings 14 for receiving breasts of a person lying against the support device 10. Optionally, the body 12 may be covered with a cover or other cushioning material at least partially covering exposed surfaces of the body 12, e.g., such as the covers 20, 120, 220, 320 shown in FIGS. 9-13 and described further elsewhere herein.

The body 12 may be formed from a one or more sections of conformable material having the openings 14 therein. For example, the body 12 may be formed from a single section of conformable material, e.g., by molding, mechanically cutting, laser cutting, stamping, and the like. The body 12 may be made from a variety of materials, e.g., foam, fabric, fiber-fill, and the like, that are substantially conformable and/or resilient. Alternatively, the body 12 may be formed from a fluid filled body, e.g., as disclosed in application Ser. No. 12/218,747, incorporated by reference herein, that may be partially filled with air, water, or other fluid to provide a conformable body. As used herein, "conformable" means that the material is sufficiently flexible to yield when a user lies against the body 12, e.g., to conform to the user's shape while providing comfort, yet is sufficiently resilient to expand and/or return substantially to its original shape when the user no longer lies against the body 12.

Figure 5:
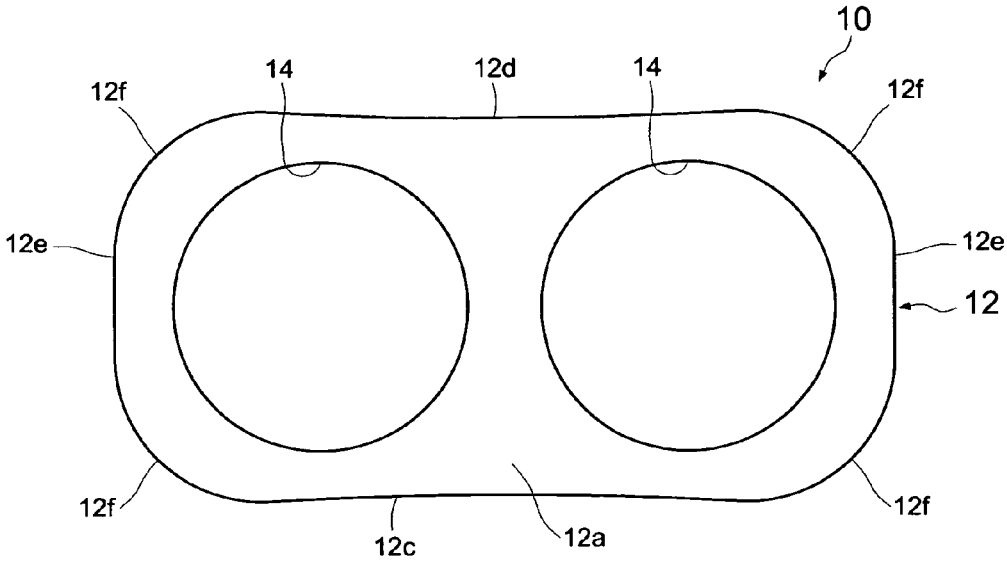
FIGS. 5 and 6 are top and bottom views, respectively, of the device of FIGS. 1 and 2.
Figure 6:
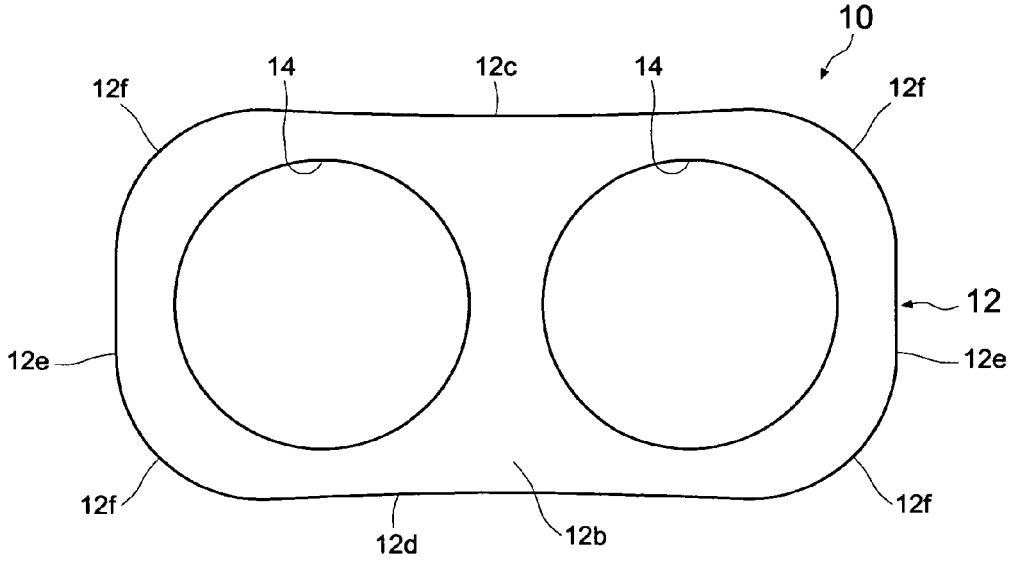
Figure 7:
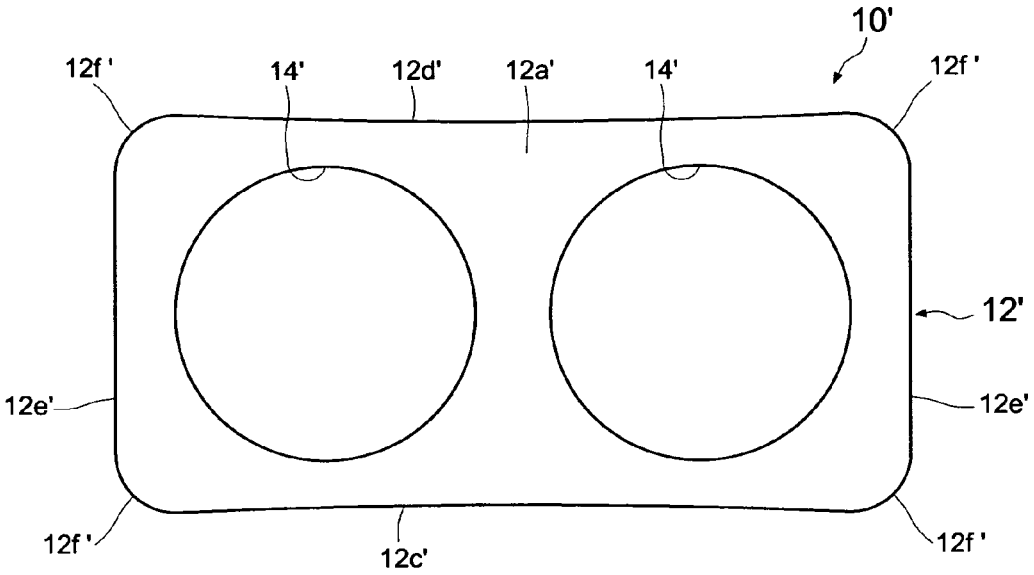
FIG. 7 is a top view of another exemplary embodiment of a cushioned support device.

As shown, the body 12 may be a substantially planar member, e.g., having a generally rectangular or other elongated shape, including an upper surface 12*a*, a lower surface 12*b*, and side surfaces 12*c*, 12*d* extending between end surfaces 12*e*. The corners 12*f* between the side surfaces 12*c*, 12*d* and end surfaces 12*e* may be rounded, as best seen in FIGS. 5 and 6. The corners 12*f* may have a radius of curvature similar to the radius of the openings 14, as shown in FIGS. 5 and 6, the corners 12*f'* may have a radius of curvature smaller than the radius of the openings 14,' as shown in FIG. 7, or may have a radius of curvature that is larger than the radius of the openings (not shown). Optionally, the edges between the upper surface 12*a* and side surfaces 12*c*, 12*d* and ends 12*e* (and/or between the lower surface 12*b*) may also be rounded or otherwise transitioned to eliminate abrupt corners.

Figure 3:
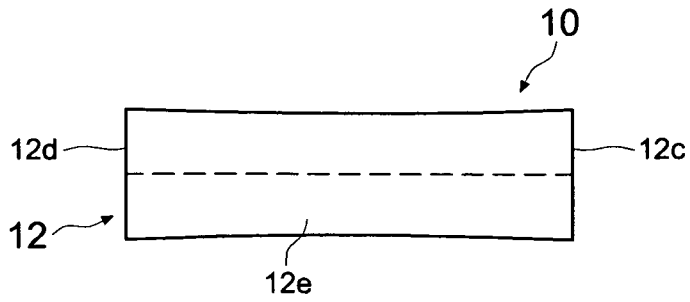
FIGS. 3 and 4 are left and right side views, respectively, of the device of FIGS. 1 and 2.
Figure 3A:
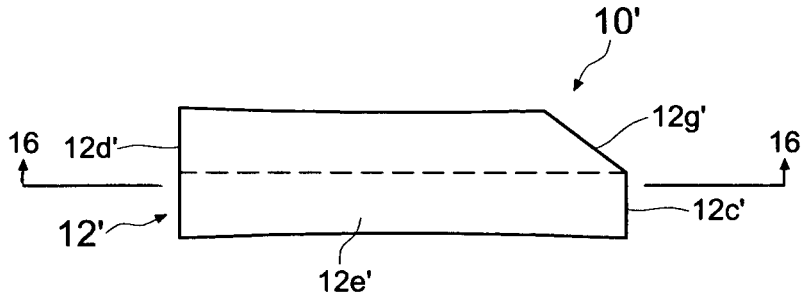
FIGS. 3A and 4A are left and right side views, respectively, of an alternative embodiment of the device of FIGS. 1 and 2.
Figure 4:
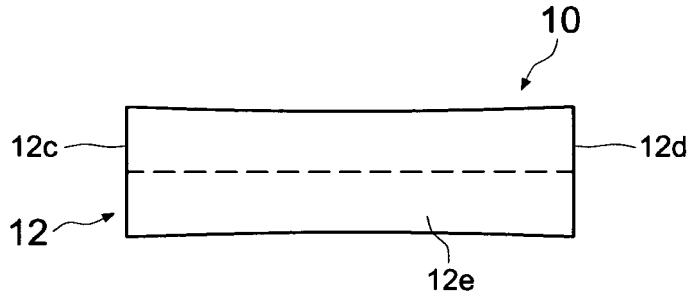
Figure 4A:
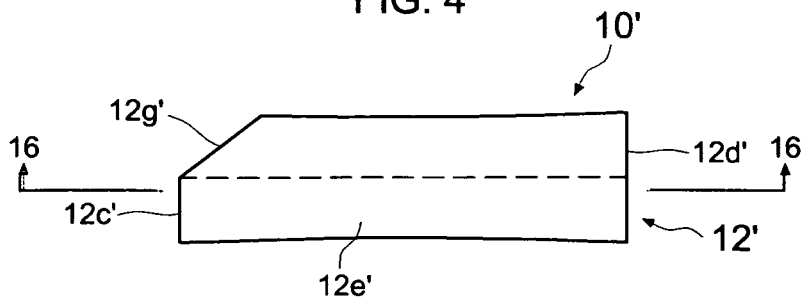

The body 12 may have a substantially uniform thickness between the upper and lower surfaces 12*a*, 12*b*, e.g., as shown in FIGS. 3 and 4. Alternatively, the body may have a variable thickness in different regions around the frame 16. For example, as shown in FIGS. 3A and 4A, the body 12' may have a beveled or tapered thickness, e.g., a beveled surface 12*g'* adjacent the front side surface 12*c'* extending towards the rear side surface 12*e*.' The beveled surface 12*g'* may extend from the front side surface 12*c'* rearwardly towards the rear side surface 12*e'* a relatively small distance, e.g., less than half the width of the body 12' or may extend greater than half the width, if desired.

Returning to FIGS. 1-6, the body 12 may have a length between the ends 12*e* of between about ten to twenty inches e.g., at least about eleven inches, a width between the side surfaces 12*c*, 12*d* of between about six and twelve inches, e.g., at least about eighth inches, and a maximum thickness between about one and five inches, e.g., at least about two inches.

It will be appreciated that the dimensions of the body 12 may be varied to accommodate women of different sizes and/or proportions, and that a range of different support devices 10 having various dimensions may be provided, as desired.

As shown, the body 12 includes a pair of substantially circular openings 14 that extend entirely through the body 12 from the upper surface 12*a* to the lower surface 12*b*. The openings 14 may be spaced apart from one another, e.g., at least about one inch, and may be located symmetrically between the ends 12*d* and/or between the side surfaces 12*c*, 12*d*. The openings 14 may be defined by cylindrical inner walls 14*a* having a substantially uniform diameter between the upper and lower surfaces 12*a*, 12*b*, e.g., between about four and nine inches, e.g., at least about five inches. Alternatively, the openings 14 may extend only partially through the body 12 form the upper surface 12*a* towards the lower surface 12*b*, e.g., defining a substantially flat or tapered, e.g., conical, semi-spherical, and the like, bottom surface (not shown). In addition or alternatively, the openings 14 may have a non-uniform diameter or cross-section, e.g., tapered inwardly from the upper surface 12*a* towards the lower surface 12*b* (also not shown).

Figure 8:
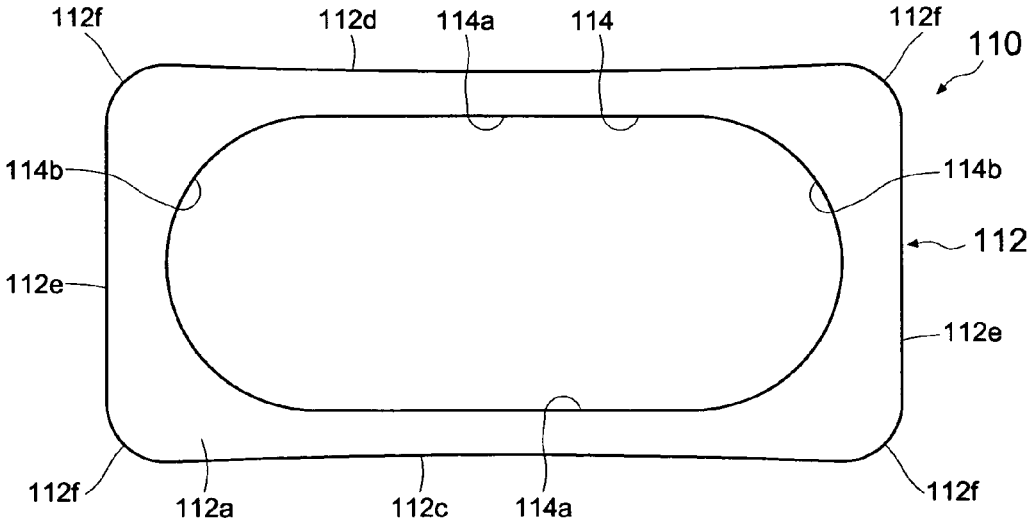
FIG. 8 is a top view of yet another exemplary embodiment of a cushioned support device.

In a further alternative, shown in FIG. 8, a cushioned support device 110 may include a single elongate opening 114 extending at least partially through a body 112. The body 112 may be formed from conformable material and generally includes an upper surface 112*a*, lower surface (not shown), side surfaces 112*c*, 112*d*, and ends 112*e*, similar to the previous embodiments. In an exemplary embodiment, the opening 114 may have substantially straight sidewalls 114*a* extending substantially parallel to the side surfaces 112*c*, 112*d* between endwalls 114*b*. Thus, the opening 114 may have a rounded rectangular shape, or alternatively an oval or other oblong shape. The opening 114 may extend entirely or only partially from the upper surface 112*a* towards the lower surface, also similar to the previous embodiments.

Optionally, in any of the embodiments herein, a layer of fabric, textile, plush, synthetic material, and the like may be provided over the cushioned support device. For example, turning to FIGS. 9, 10, 15 and 16, an exemplary embodiment of a cover 20 is shown that may substantially surround or encase the support device 10 of FIGS. 1-6. Generally, the cover 20 includes one or more pieces, panels, or sheets of material, e.g., at least seven (or alternatively, more or fewer) separate panels attached together, e.g., by stitching, bonding with adhesive, fusing, and the like. Similar to the support device 10, the cover 20 has a generally rectangular shape including a top surface 20*a*, a bottom surface 20*b*, side surfaces 20*c*, 20*d*, and end surfaces 20*e*.

Figure 10:
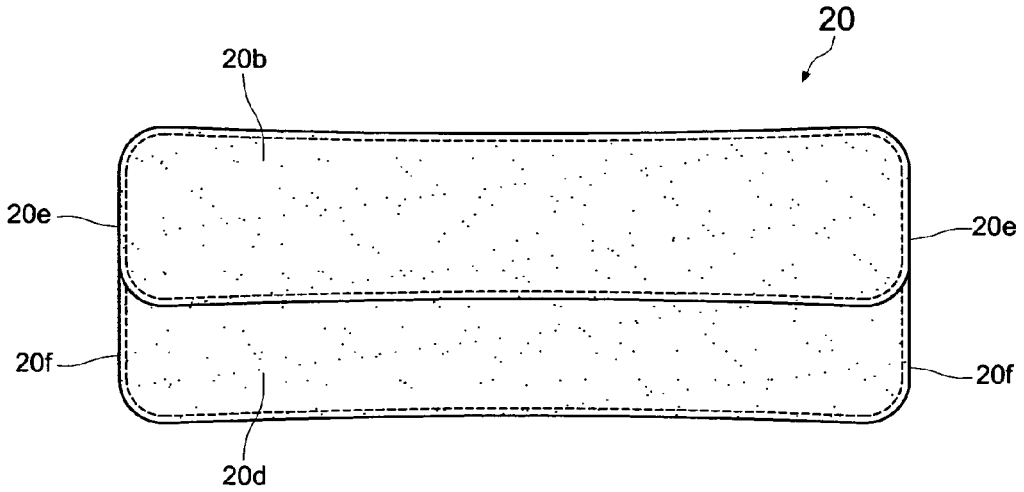
FIG. 10 is a rear perspective view of the cover of FIG. 9.
Figure 11:
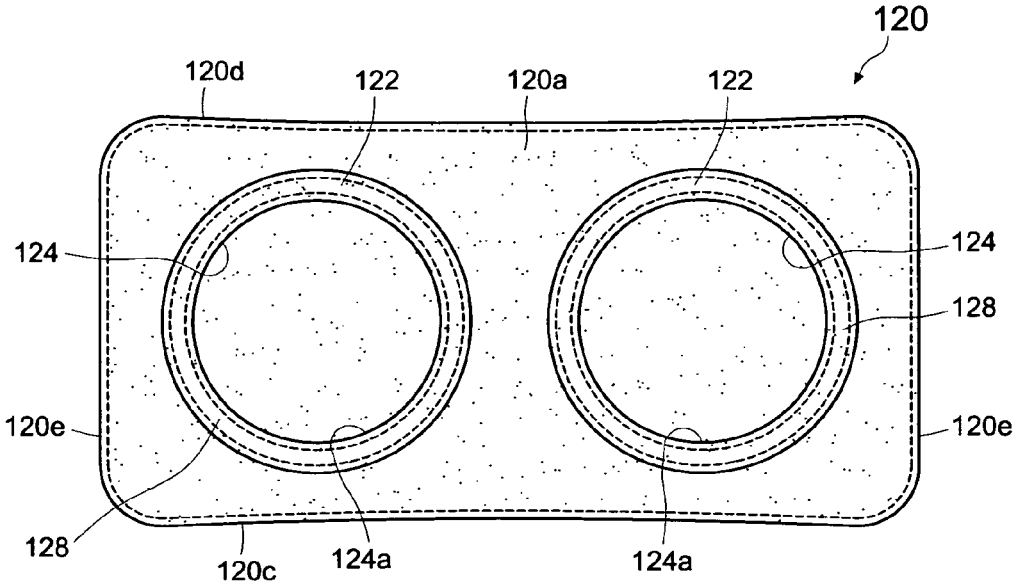
FIGS. 11 and 12 are top and bottom views, respectively, of an alternative embodiment of a cover for a cushioned support device, such as the device of FIGS. 1 and 2.
Figure 12:
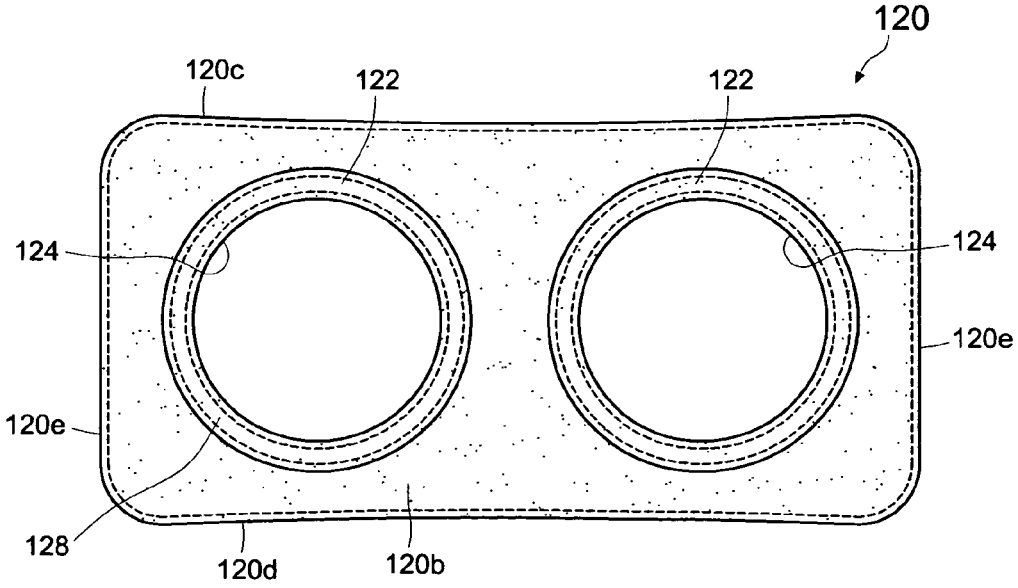

The top surface 20*a* may be a panel including two spaced apart openings 22 therein, e.g., sized and positioned similar to the openings 14 in the support device 10. For example, the openings 22 may be substantially circular and spaced apart symmetrically on the top surface 20*a*. The bottom surface 20*b* may be a substantially continuous sheet, as shown in FIG. 10, or may include two openings (not shown) sized and positioned similar to the openings 22, e.g., generally opposite the openings 22, e.g., similar to the cover 120 shown in FIGS. 11 and 12. The side and end surfaces 20*c*, 20*d*, 20*e* may be formed from multiple sheets attached together, e.g., at corners 20*f* extending between the top and bottom surfaces 20*a*, 20*b*. Alternatively, the side and end surfaces 20*c*, 20*d*, 20*e* may be formed from a single sheet that extends around the entire periphery of the cover 20, e.g., including a single vertical seam between the top and bottom surfaces 20*a*, 20*b* (not shown). The width of the sheet(s) providing the side and end surfaces 20*c*, 20*d*, 20*e* generally define the thickness of the cover 20, which may be similar or slightly thicker than the thickness of the support device 10.

Figure 9:
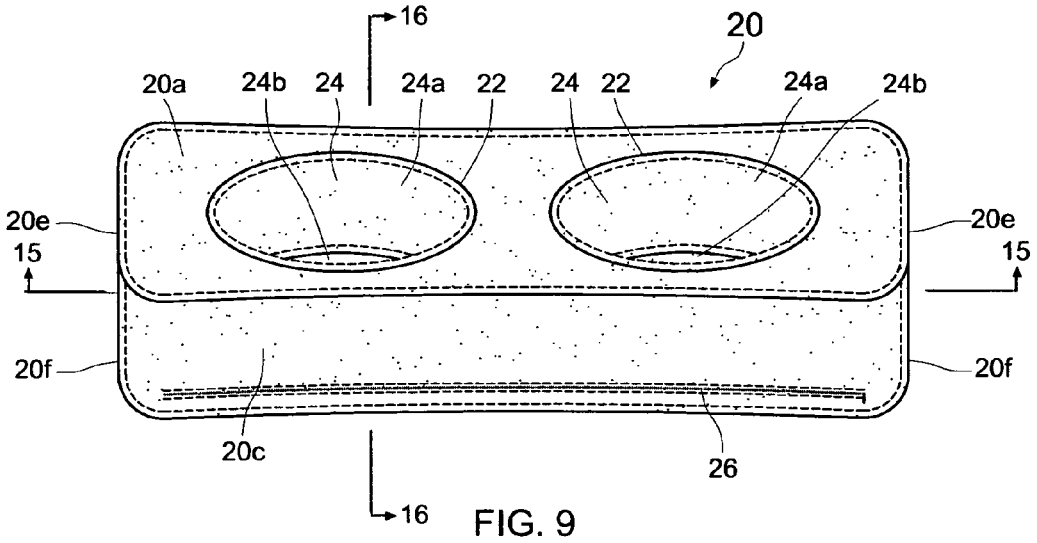
FIG. 9 is a front perspective view of a cover for a cushioned support device, such as the device of FIGS. 1 and 2.

The cover 20 includes a recess 24 extending inwardly from each opening 22, which may also be defined by one, two, or more sheets of material. For example, each recess 24 may include a generally rectangular side panel defining the sidewall 24*a*, and a substantially circular panel defining the bottom surface 24*b* of the recess 24. One edge of each side panel 24*a* may be stitched or otherwise attached around the respective opening 22 in the top surface 20*a*, and the opposite edge may be stitched or otherwise attached around the periphery of the respective bottom panel 24*b* to define each recess 24, as best seen in FIG. 9. Alternatively, if the bottom surface of the cover 20 includes openings therein, the bottom edge of each side panel 24*a* may be stitched or otherwise attached to the bottom surface around the respective opening.

The cover 20 may be removable from around the support device 10, or may be substantially permanently attached to the body 12, e.g., by bonding with adhesive, fusing, melting, and the like. For example, as shown in FIG. 9, the cover 20 may include a reclosable opening 26 through which the support device 10 may be inserted and/or removed. As shown, the opening 26 may be an elongate slot extending along the front side surface 20*c* and may include a reclosable fastener, e.g., a zipper, hook-and-eye fastener, buttons, snaps, and the like (not shown). It will be appreciated that one or more openings may be provided at other locations on the cover 20, e.g., in the bottom surface 20*b*, the rear side surface 20*d*, or along one or more edges between the various surfaces of the cover 20 (not shown).

To insert the support device 10 into the cover 20, any fastener along the opening 26 may be opened, and the support device 10 inserted through the opening 26 such that the openings 14 in the support device 10 are aligned with the panels 24*a*, 24*b* of the recesses 24 in the cover 20, and the corresponding surfaces of the cover 20 and support device 10 are disposed adjacent one another. The panels 24*a*, 24*b* may be directed outwardly away from the interior of the cover 20 when the support device 10 is inserted, and then the panels 24*a*, 24*b* may be directed inwardly such that they line the openings 14 in the support device 10. The fastener(s) along the opening 26 may then be closed. At any time, if it is desired to remove the support device 10, e.g., to clean or replace either component, the opening 26 may be opened, and the support device 10 removed.

Optionally, any of the covers herein may include a desired pattern or images, e.g., to provide a desired aesthetic appearance for the support device received therein. For example, different panels of the covers may be provided from different materials, e.g., having contrasting colors and/or patterns. In an exemplary embodiment, with reference to the cover 20 of FIG. 9, the panels 24*a*, 24*b* of the recess 24 may have a contrasting color with at least the top surface 20*a* and/or side surfaces 20*c*, 20*d*.

In addition or alternatively, any of the covers herein may include stitching patterns, e.g., to provide functional seams between adjacent panels and/or to provide a desired aesthetic finish to the cover. For example, as shown in FIG. 9, the cover 20 may include a single row of stitches for each seam, e.g., around the perimeter of the top surface 20*a*, the bottom surface, and vertically along the corners 20*f*. In addition, a single row of stitches may be provided around the openings 22 at the top of the recesses 24 and around the bottom of the recesses 24. Alternatively, a pair of parallel stitches may be provided along one or more seams (not shown), e.g., similar to the stitches shown around the openings 122 in the cover 120 of FIGS. 11 and 12.

Optionally, any of the covers herein may include padding along one or more panels or surfaces, e.g., to provide additional cushioning or other desired properties when a support device is received within the cover. For example, turning to FIGS. 11 and 12, a cover 120 is shown that is generally similar to the cover 20 (with similar features including reference numbers preceded by 100), e.g., including a top surface 120*a*, bottom surface 120*b*, side surfaces 120*c*, 120*d*, and end surfaces 120*e*, and including a pair of spaced apart openings 122 and recesses 124.

Unlike the previous embodiments, the cover 120 includes a padded layer 128 surrounding the sidewalls 124*a* of each recess 124. Each padded layer 128 may be attached to the sidewall 124*a* opposite the respective recess 124, i.e., within the interior of the cover 120, e.g., by stitching, bonding with adhesive, fusing, and the like. The padded layers 128 may include a layer of relatively soft material, e.g., relative to the support device 10 of FIGS. 1-6 intended to be received within the cover 120, for example, cotton, having a thickness between about half and two inches (12.3-5.0 cm). Thus, the recesses 124 may have diameters smaller than the openings 14 in the support device 10 to be received therein to accommodate the padded layers being disposed within the openings 14. In this manner, the padded layers 128 may provide additional comfort or other desired properties when the support device 10 is used by a woman.

Figure 13:
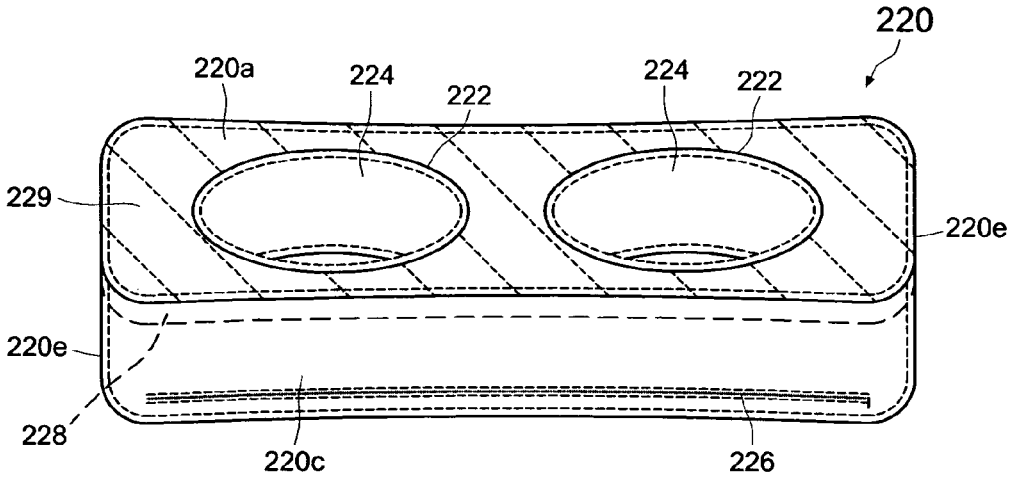
FIG. 13 is a front perspective view of another embodiment of a cover for a cushioned support device, such as the device of FIGS. 1 and 2.

In another embodiment, shown in FIG. 13, a cover 220 may be provided that includes a top surface 220*a*, bottom surface, side surfaces 220*c*, and end surfaces 220*e*, and including a pair of spaced apart openings 222 and recesses 224, generally similar to the previous embodiments (with similar features including reference numbers preceded by 200). Unlike the previous embodiments, the top surface 220*a* includes a padded layer 228 attached thereto, e.g., within an interior of the cover 220. Similar to the padded layers 128 of the cover 120, the padded layer 228 may a relatively soft material attached to the interior of the top surface 220*a*, e.g., by stitches 229, bonding with adhesive, fusing, and the like.

Figure 14:
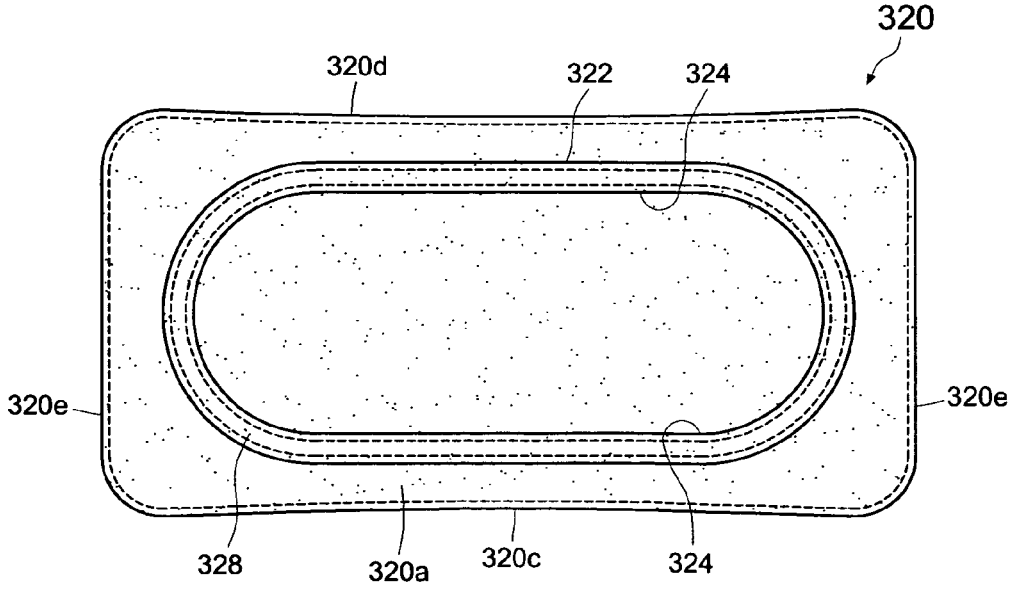
FIG. 14 is a front perspective view of yet another embodiment of a cover for a cushioned support device, such as the device of FIG. 8.
Figure 15:
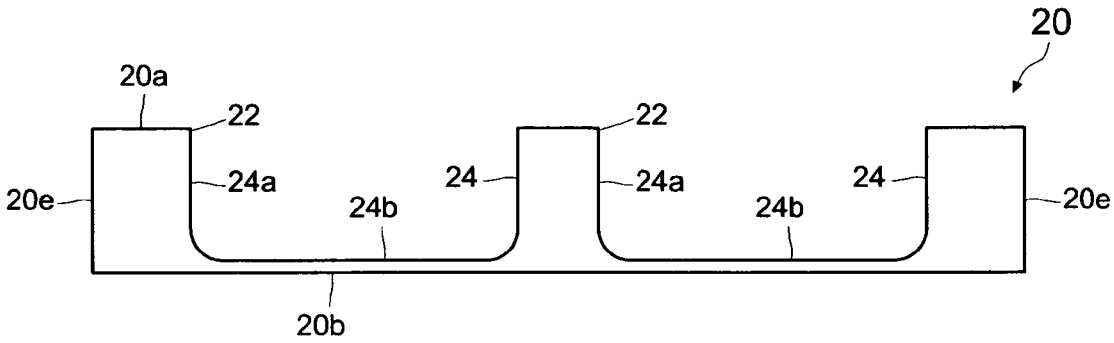
FIG. 15 is a cross-sectional view of the cover of FIG. 9, taken along line 15-15.
Figure 16:
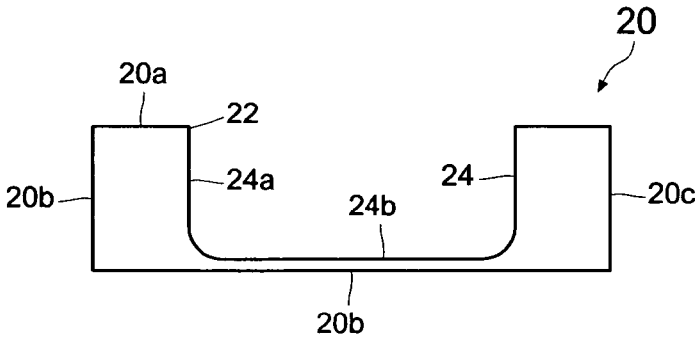
FIG. 16 is a cross-sectional view of the cover of FIG. 9, taken along line 16-16.

Turning to FIG. 14, yet another embodiment of a cover 320 is shown that is generally similar to the cover 120, except that the cover 320 includes a single elongate opening 322 and recess 324. The cover 320 includes a top surface 320*a*, bottom surface, side surfaces 320*c*, 320*d*, and end surfaces 320*e*, and includes an elongated opening 322 and recess 324 surrounded by a padded layer 328.

It will be appreciated that elements or components shown with any embodiment herein are exemplary for the specific embodiment and may be used on or in combination with other embodiments disclosed herein.

While embodiments of the present invention have been shown and described, various modifications may be made without departing from the scope of the present invention. The invention, therefore, should not be limited, except to the following claims, and their equivalents.

I claim:

1. A cushioned support device, comprising:

a conformable body comprising an upper surface, a lower surface, and side surfaces extending between end surfaces, the body further comprising a pair of spaced apart openings extending from the upper surface towards the lower surface, each opening defining a sidewall and a beveled surface adjacent a front side surface that extends towards a rear side surface a relatively small distance less than half the width of the unbeveled upper surface of the body, wherein the body has a generally rectangular shape wherein the distance between the end surfaces is greater than the distance between the side surfaces, wherein the spaced apart openings are aligned along the distance between the end surfaces and substantially centered along the distance between the side surfaces; and a cover for receiving the body therein, the cover comprising a top panel, a bottom panel, and side panels extending between end panels, the cover comprising panels defining recesses, the cover comprising one or more openings accessing an interior of the cover for inserting and removing the body and one or more reclosable fasteners to close the one or more openings in the cover after inserting the conformable body into the interior of the cover, the cover substantially enclosing the body such that the panels defining the recesses are disposed within the spaced apart openings in the body.

2. The support device of claim 1, wherein the cover comprises a padded layer surrounding panels defining sidewalls of the recesses.

3. The support device of claim 1, wherein the cover comprises a padded layer attached to an inner surface of the top panel of the cover.

4. The support device of claim 1, wherein the openings in the body have substantially uniform diameters that extend only partially from the upper surface to the lower surface.

5. The support device of claim 1, wherein the openings in the body extend from the upper surface entirely through the body to the lower surface.

6. The support device of claim 1, wherein the openings in the body comprise sidewalls having a substantially uniform diameter.

7. The support device of claim 1, wherein the openings in the body are spaced apart symmetrically between the end surfaces.

8. The support device of claim 1, wherein the openings in the body are spaced apart from one another at least about one inch.

9. The support device of claim 1, wherein the openings in the body are spaced apart symmetrically between the side surfaces.

10. The support device of claim 1, wherein the body has a thickness sufficient to raise the user's body away from the support surface.

11. The support device of claim 1, wherein the side surfaces have a height between the upper and lower surfaces of at least about two inches, thereby defining the thickness of the conformable body.

12. The support device of claim 1, wherein the conformable body has a substantially planar surface.

13. The support device of claim 1, wherein the conformable body has a variable thickness in different regions around the upper surface.

14. The support device of claim 1, wherein the one or more reclosable fasteners comprise one of a zipper, a hook-and-eye fastener, buttons, and snaps.

15. A cushioned support device, comprising:

a conformable body comprising an upper surface, a lower surface, side surfaces extending between end surfaces such that the body defines a length between the end surfaces and a width between the side surfaces, and a beveled surface adjacent a front side surface that extends towards a rear side surface a relatively small distance less than half the width of the unbeveled upper surface of the body, the body further comprising a pair of spaced apart openings extending from the upper surface towards the lower surface, aligned along the length of the body and substantially centered across the width, each opening defining a sidewall, wherein the body has a generally rectangular shape wherein the distance between the end surfaces is greater than the distance between the side surfaces.

16. The support device of claim 15, further comprising a cover for receiving the body therein, the cover comprising a top panel, a bottom panel, and side panels extending between end panels, the cover comprising panels defining recesses, the cover comprising one or more openings accessing an interior of the cover for inserting and removing the body and one or more reclosable fasteners to close the one or more openings in the cover after inserting the conformable body into the interior of the cover, the cover substantially enclosing the body such that the panels defining the recesses are disposed within the openings in the body.

17. The support device of claim 15, wherein corners between the side surfaces and the end surfaces are rounded.

18. A cushioned support device, comprising:

a conformable body comprising an upper surface, a lower surface, side surfaces extending between end surfaces such that the body defines a length between the end surfaces and a width between the side surfaces, and a beveled surface adjacent a front side surface that extends towards a rear side surface a relatively small distance less than half the width of the unbeveled upper surface of the body, the body further comprising openings extending from the upper surface towards the lower surface, aligned along the length of the body and substantially centered across the width, each opening defining a sidewall: and a cover for receiving the body therein, the cover comprising a top panel, a bottom panel, and side panels extending between end panels, the cover comprising panels defining recesses, the cover comprising one or more openings accessing an interior of the cover for inserting and removing the body and one or more reclosable fasteners to close the one or more openings in the cover after inserting the conformable body into the interior of the cover, the cover substantially enclosing the body such that the panels defining the recesses are disposed within the openings in the body, wherein the openings in the body have substantially uniform diameters that extend only partially from the upper surface to the lower surface, and wherein the bottom panel of the cover is continuous.

* * * * *